US010865617B2

(12) United States Patent
Deng et al.

(10) Patent No.: US 10,865,617 B2
(45) Date of Patent: Dec. 15, 2020

(54) ONE-WAY ENERGY RETENTION DEVICE, METHOD AND SYSTEM

(71) Applicants: Guijun Deng, The Woodlands, TX (US); Lei Zhao, Houston, TX (US); Zhihui Zhang, Katy, TX (US); Zhiyue Xu, Cypress, TX (US)

(72) Inventors: Guijun Deng, The Woodlands, TX (US); Lei Zhao, Houston, TX (US); Zhihui Zhang, Katy, TX (US); Zhiyue Xu, Cypress, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 0 days.

(21) Appl. No.: 16/393,622

(22) Filed: Apr. 24, 2019

(65) Prior Publication Data

US 2019/0249510 A1 Aug. 15, 2019

Related U.S. Application Data

(63) Continuation-in-part of application No. 15/385,021, filed on Dec. 20, 2016, now Pat. No. 10,450,840.

(51) Int. Cl.

| | |
|---|---|
| ***E21B 33/12*** | (2006.01) |
| ***E21B 23/04*** | (2006.01) |
| ***E21B 33/128*** | (2006.01) |

(52) U.S. Cl.
CPC ..... *E21B 33/1208* (2013.01); *E21B 33/128* (2013.01)

(58) Field of Classification Search
CPC ..... E21B 29/02; E21B 33/1208; E21B 23/04
USPC ..... 166/376
See application file for complete search history.

(56) References Cited

U.S. PATENT DOCUMENTS

| | | | | |
|---|---|---|---|---|
| 2,637,402 | A | 5/1953 | Baker et al. | |
| 2,695,064 | A | 11/1954 | Ragan et al. | |
| 2,857,847 | A | 10/1958 | Seavey et al. | |
| 3,497,002 | A * | 2/1970 | Berryman | E21B 33/129 166/123 |
| 3,687,196 | A * | 8/1972 | Mullins | E21B 23/01 166/217 |
| 4,527,481 | A | 7/1985 | Evans et al. | |
| 5,052,489 | A | 10/1991 | Carisella et al. | |
| 5,386,780 | A | 2/1995 | Klein | |
| 5,680,905 | A | 10/1997 | Green et al. | |
| 5,709,269 | A * | 1/1998 | Head | E21B 17/06 166/120 |

(Continued)

FOREIGN PATENT DOCUMENTS

| | | | |
|---|---|---|---|
| EP | 0122012 | A2 | 10/1984 |
| GB | 143268 | A | 9/1921 |
| WO | 2013022635 | A2 | 2/2013 |

OTHER PUBLICATIONS

"Spectre Disintegrating Frac Plug", Baker Hughes, 2015, 8 Pages.

(Continued)

*Primary Examiner* — Kenneth L Thompson
(74) *Attorney, Agent, or Firm* — Cantor Colburn LLP

(57) ABSTRACT

A one-way energy retaining device including a body, at least a portion of which comprises a degradable material; a protrusion extending radially from the body that allows movement of the device along a separate structure in a first direction and prevents movement along the separate structure in the opposite direction.

15 Claims, 4 Drawing Sheets

(56) References Cited

U.S. PATENT DOCUMENTS

| | | | | |
|---|---|---|---|---|
| 5,911,277 | A | 6/1999 | Hromas et al. | |
| 6,253,843 | B1 | 7/2001 | Rawson et al. | |
| 7,270,191 | B2 | 9/2007 | Drummond et al. | |
| 7,475,736 | B2 * | 1/2009 | Lehr | E21B 33/1204 166/120 |
| 7,726,406 | B2 * | 6/2010 | Xu | E21B 23/00 166/376 |
| 8,056,638 | B2 | 11/2011 | Clayton et al. | |
| 8,235,102 | B1 | 8/2012 | Robertson | |
| 8,256,521 | B2 | 9/2012 | Swor et al. | |
| 8,272,446 | B2 | 9/2012 | Swor et al. | |
| 8,291,969 | B2 | 10/2012 | Swor et al. | |
| 8,291,970 | B2 | 10/2012 | Swor et al. | |
| 8,322,449 | B2 | 12/2012 | Clayton et al. | |
| 8,327,926 | B2 | 12/2012 | Robertson | |
| 8,403,037 | B2 | 3/2013 | Agrawal et al. | |
| 8,485,265 | B2 | 7/2013 | Marya et al. | |
| 8,528,633 | B2 | 9/2013 | Agrawal et al. | |
| 9,022,107 | B2 | 5/2015 | Agrawal et al. | |
| 9,101,978 | B2 | 8/2015 | Xu et al. | |
| 9,163,467 | B2 * | 10/2015 | Gaudette | E21B 29/00 |
| 9,228,404 | B1 * | 1/2016 | Jackson | E21B 33/129 |
| 9,267,347 | B2 | 2/2016 | Agrawal et al. | |
| 9,334,719 | B2 | 5/2016 | Rytlewski et al. | |
| 9,528,342 | B2 * | 12/2016 | Xu | E21B 33/1293 |
| 9,656,926 | B1 | 5/2017 | Thoma et al. | |
| 9,689,247 | B2 | 6/2017 | Holder et al. | |
| 9,816,339 | B2 * | 11/2017 | Xu | E21B 33/12 |
| 10,087,714 | B2 * | 10/2018 | Harper | E21B 23/004 |
| 10,167,691 | B2 | 1/2019 | Zhang et al. | |
| 2004/0216887 | A1 * | 11/2004 | Bertelsen | E21B 17/06 166/377 |
| 2007/0209802 | A1 | 9/2007 | Xu et al. | |
| 2008/0251261 | A1 * | 10/2008 | Arce | E21B 33/04 166/387 |
| 2010/0101803 | A1 | 4/2010 | Clayton et al. | |
| 2011/0000663 | A1 | 1/2011 | Brandsdal | |
| 2013/0062055 | A1 | 3/2013 | Tolman et al. | |
| 2013/0081825 | A1 | 4/2013 | Lynde et al. | |
| 2013/0118805 | A1 | 5/2013 | Moody-Stuart et al. | |
| 2013/0160992 | A1 | 6/2013 | Agrawal et al. | |
| 2014/0014339 | A1 | 1/2014 | O'Malley et al. | |
| 2014/0190685 | A1 | 7/2014 | Frazier et al. | |
| 2014/0202712 | A1 | 7/2014 | Fripp et al. | |
| 2014/0251612 | A1 | 9/2014 | Powers | |
| 2014/0262327 | A1 | 9/2014 | Xu et al. | |
| 2014/0345878 | A1 | 11/2014 | Murphree et al. | |
| 2014/0363692 | A1 | 12/2014 | Marya et al. | |
| 2015/0021023 | A1 | 1/2015 | Roberts et al. | |
| 2015/0027723 | A1 | 1/2015 | Fripp et al. | |
| 2015/0159468 | A1 | 6/2015 | Mailand | |
| 2015/0190984 | A1 | 7/2015 | Zhang et al. | |
| 2015/0239795 | A1 | 8/2015 | Doud et al. | |
| 2015/0259263 | A1 | 9/2015 | Sherman et al. | |
| 2015/0292288 | A1 | 10/2015 | Kasperski et al. | |
| 2016/0130906 | A1 | 5/2016 | Garvey et al. | |
| 2016/0186044 | A1 | 6/2016 | Rothrock et al. | |
| 2016/0209391 | A1 | 7/2016 | Zhang et al. | |
| 2016/0290093 | A1 * | 10/2016 | Doane | E21B 33/128 |
| 2016/0333668 | A1 | 11/2016 | Xu et al. | |
| 2017/0009563 | A1 | 1/2017 | Holder | |
| 2017/0138169 | A1 | 5/2017 | Bogdan et al. | |
| 2017/0218722 | A1 | 8/2017 | Gordon et al. | |
| 2018/0171736 | A1 | 6/2018 | Xu et al. | |
| 2018/0171737 | A1 | 6/2018 | Xu et al. | |
| 2018/0171738 | A1 | 6/2018 | Xu et al. | |
| 2018/0171757 | A1 | 6/2018 | Xu | |
| 2018/0230769 | A1 | 8/2018 | Xu et al. | |
| 2018/0230770 | A1 | 8/2018 | Oag et al. | |
| 2018/0245448 | A1 | 8/2018 | Fripp et al. | |
| 2018/0252070 | A1 | 9/2018 | Zhu et al. | |
| 2018/0283119 | A1 | 10/2018 | Zhang et al. | |
| 2018/0283121 | A1 | 10/2018 | Zhang et al. | |
| 2018/0283141 | A1 | 10/2018 | Zhang et al. | |
| 2018/0283142 | A1 | 10/2018 | Zhang et al. | |
| 2018/0334873 | A1 | 11/2018 | Marya | |
| 2019/0032435 | A1 | 1/2019 | Kochanek et al. | |
| 2019/0078410 | A1 | 3/2019 | Xu et al. | |

OTHER PUBLICATIONS

Huang et al. "Construction and Properties of Structure- and Size-controlled Micro/nano-Energetic Materials", Defence Technology 9 (2013) 59-79.

International Search Report for International Application No. PCT/US2017/062263, dated Feb. 22, 2018, Korean Intellectual Property Office; International Search Report 7 pages.

International Search Report for International Application No. PCT/US2017/062264, dated Mar. 9, 2018, 7 pages.

International Search Report for International Application No. PCT/US2017/062275, dated Mar. 12, 2018, 4 pages.

International Search Report for International Application No. PCT/US2017/062278, dated Mar. 8, 2018, 7 pages.

International Search Report for International Application No. PCT/US2017/062286, dated Mar. 13, 2018, 7 pages.

International Search Report for International Application No. PCT/US2017/062291, dated Feb. 20, 2018, 7 pages.

International Search Report for International Application No. PCT/US2017/062292, dated Mar. 16, 2018, 4 pages.

International Search Report, International Application No. PCT/US2017/062285, dated Mar. 5, 2018, Korean Intellectual Property Office; International Search Report 7 pages.

International Written Opinion, International Application No. PCT/US2017/062263, dated Feb. 22, 2018, Korean Intellectual Property Office; International Written Opinion 11 pages.

International Written Opinion, International Application No. PCT/US2017/062285, dated Mar. 5, 2018, Korean Intellectual Property Office; International Written Opinion 11 pages.

Notification of Transmittal of the International Search Report and the Written Opinion of the International Searching Authority; PCT/US2018/047315; dated Dec. 21, 2018; 12 pages.

Witten Opinion of the International Search Report for International Application No. PCT/US2017/062264, dated Mar. 9, 2018, 11 pages.

Witten Opinion of the International Search Report for International Application No. PCT/US2017/062275, dated Mar. 12, 2018, 12 pages.

Witten Opinion of the International Search Report for International Application No. PCT/US2017/062278, dated Mar. 8, 2018, 11 pages.

Written Opinion of the International Search Report for International Application No. PCT/US2017/062286, dated Mar. 13, 2018, 11 pages.

Written Opinion of the International Search Report for International Application No. PCT/US2017/062291, dated Feb. 20, 2018, 11 pages.

Written Opinion of the International Search Report for International Application No. PCT/US2017/062292, dated Mar. 16, 2018, 12 pages.

* cited by examiner

ONE-WAY ENERGY RETENTION DEVICE, METHOD AND SYSTEM

CROSS REFERENCE TO RELATED APPLICATIONS

The present application is a continuation-in-part of U.S. patent application Ser. No. 15/385,021, filed Dec. 20, 2016, which is hereby incorporated by reference in its entirety.

BACKGROUND

In the drilling and completion industry, there is often need for the storage of energy in borehole tools through mechanical input. One example is a packer or similar seal where energy in the form of compression is imparted to a deformable resilient material and that energy is held therein by a ratcheting device such as a body lock ring. The compressive energy causes the seal to expand radially and thereby form a seal with a casing of other structure disposed radially of the tool. Body lock rings or similar devices are very effective for holding the energy in the tool but are difficult to release, generally requiring the drilling or milling out of the entire tool. This is costly and time consuming and hence undesirable. The art would welcome advancements that reduce cost and time in removing borehole tools.

SUMMARY

The subject matter disclosed herein relates to a one-way energy retaining device including a body, at least a portion of which comprises a degradable material; a protrusion extending radially from the body that allows movement of the device along a separate structure in a first direction and prevents movement along the separate structure in the opposite direction.

The subject matter disclosed herein relates to a resource recovery system including a borehole; and a tool disposed in the borehole, the tool including a device as in any prior embodiment.

The subject matter disclosed herein relates to a method of storing energy and releasing stored energy in a borehole tool including urging a device as in any prior embodiment in a first direction relative to the tool in a borehole; storing in the tool, the energy that was employed during the urging; signaling the at least a portion of the body to degrade.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
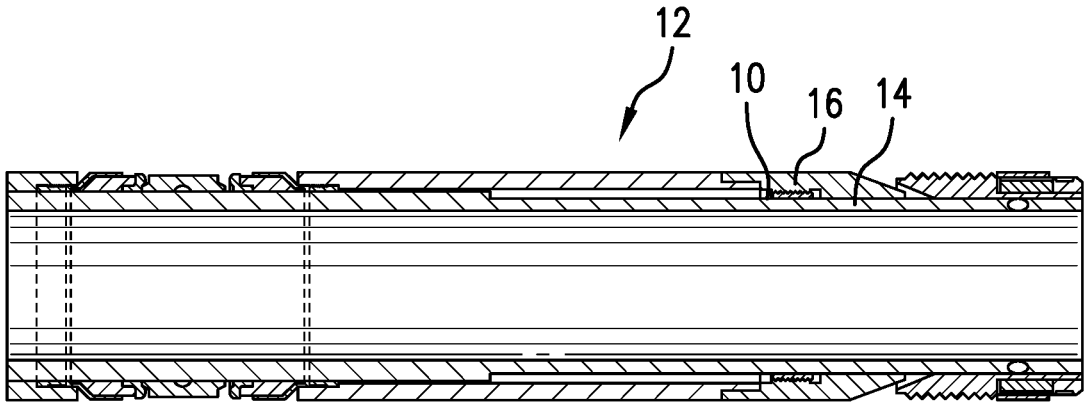
FIG. 1 is an illustration of a borehole tool configured to store applied energy.

Referring to FIG. 1, in one embodiment of a one-way energy retention device 10 having a body 11 and which is illustrated as a part of one possible borehole tool 12 is illustrated. The tool 12 is of a type that requires the retention of energy applied thereto for example by set down weight or a pull by a string from a remote location such as a surface location. The tool 12 generally includes a mandrel 14 and a housing 16, each of which interengage the device 10 to retain energy through one-way features thereon that are known to the art and too small to be visible in FIG. 1. The art is quite familiar with the procedures for setting tools of this type and trapping the energy imparted thereto using such one-way energy retention devices as Body Lock Rings. Accordingly, a detailed disclosure of the various procedures to impart energy to the tool is not necessary. Device 10 however is unique. The device allows for reliable retention of energy in the tool 12 until a trigger causes events leading to the release of that energy.

Figure 2:
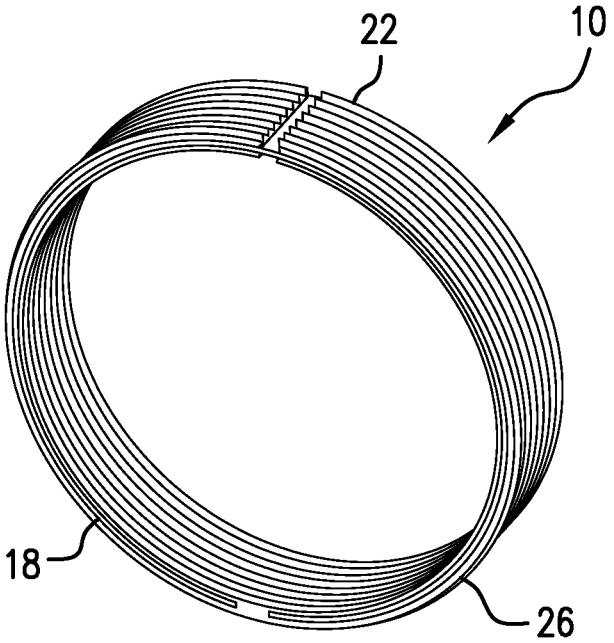
FIG. 2 is an isometric view of a one-way energy retaining device as disclosed herein.
Figure 3:
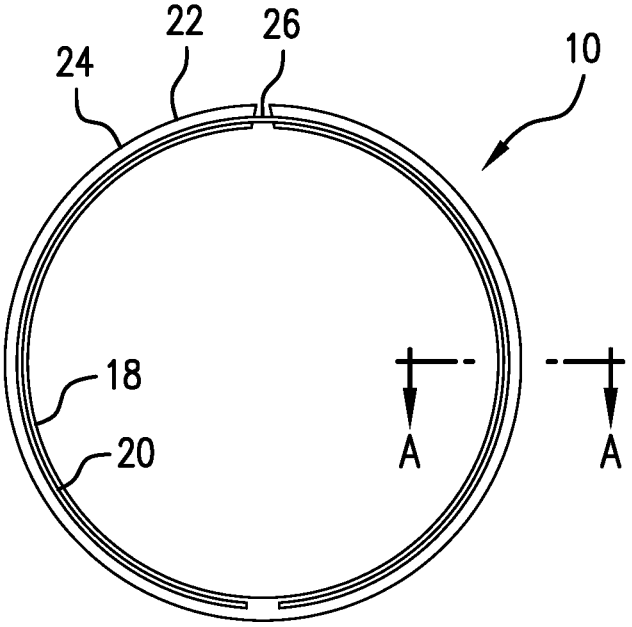
FIG. 3 is an end view of the device illustrated in FIG. 2.
Figure 4:
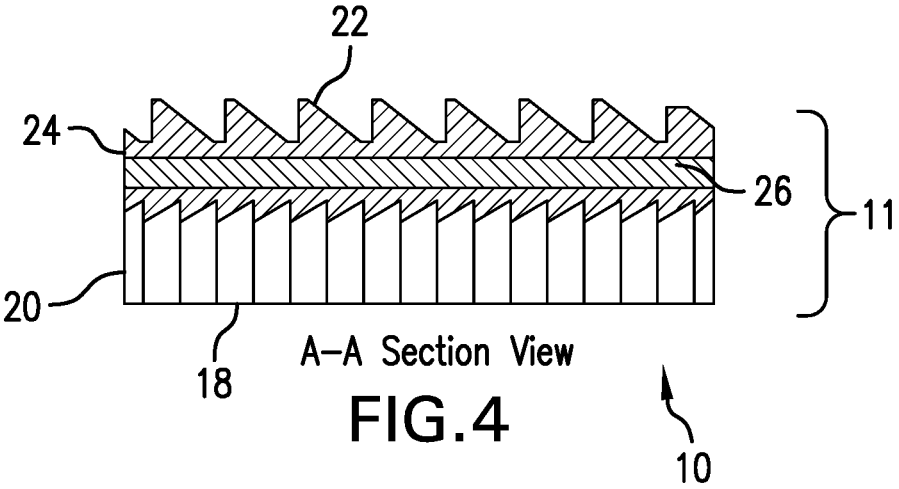
FIG. 4 is an enlarged cross sectional view of the device illustrated in FIG. 3 taken along section line 4-4.

Referring to FIG. 2, an isometric view of one embodiment of the device 10 as disclosed herein is illustrated apart from other components of a tool 12 of which it will form a part. The iteration illustrated is embodied as a body lock ring having a body 11 and including inner one-way engaging features 18 extending radially inwardly from an inner ring 20 and outer one-way engaging features 22 extending radially outwardly from an outer ring 24. The features 18 and 22 may be configured as wickers or teeth having an angle so that movement in a first direction is permitted yet movement in an opposing direction is not permitted relative to the mandrel 14 and housing 16 similar to the prior art. The device 10 in one embodiment also includes an intermediate annular portion 26 disposed between the inner ring 20 and outer ring 24. Portion 26 has for its purpose to securely hold the inner ring 20 and outer ring 24 together until a trigger event occurs, after which the portion 26 is configured to lose sufficient integrity that the inner ring 20 and outer ring 24 are no longer sufficiently bond to one another to retain the energy that has been imparted to the tool 12. At this point, the ring 20 will move relative to the ring 24 and energy will be released in the tool 12. Once rings 20 and 24 can move relative to each other, the tool 12 may be retrieved, moved, etc.

Figure 5:
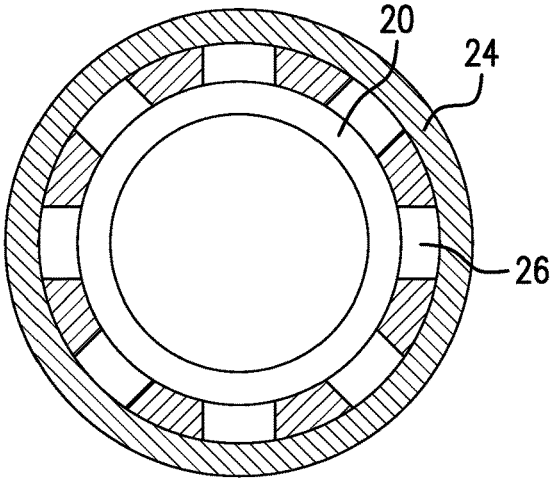
FIG. 5 is an end view of an alternate embodiment of the device.

While the first discussed embodiment uses an annular portion 26, it is to be understood that the portion may also be made from a number of portions that together with spaces therebetween make up an annular area (See FIG. 5). Portion 26 must maintain the rings 20 and 24 in position relative to each other and when triggered allow the rings 20 and 24 to move relative to each other such that the ability for the device 10 to maintain the energy stored is lost. Various layouts of portion 26 that function as noted are contemplated.

Figure 6:
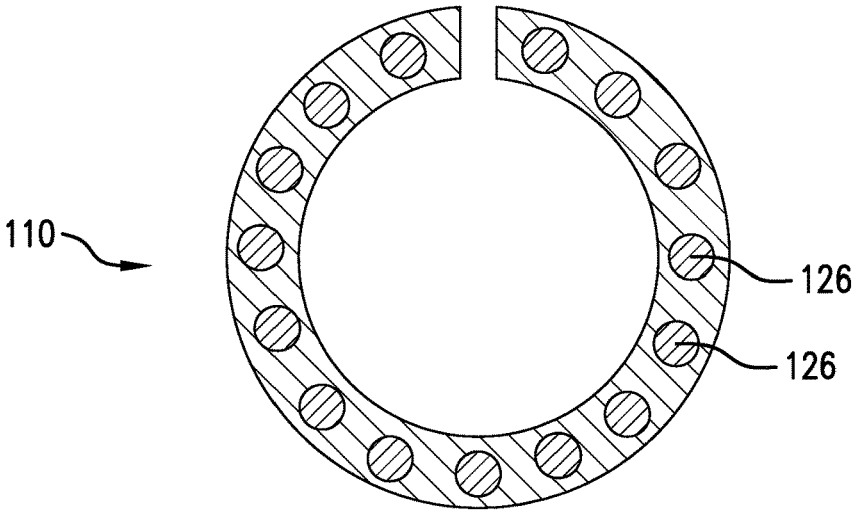
FIG. 6 is alternate device also illustrated in end view.

In another embodiment, referring to FIG. 6, the device 110 includes a number of energetic reactive composite material inserts distributed about the device 110. Upon the signal to react, the inserts 126 reduce the structural integrity of the device 110. In the illustration in FIG. 6, this would make an annular perforation through the device 110 that would reduce the structural integrity of the device 110 to the point that the load it supports exceeds its capacity and the device 110 will shear thereby allowing the setting energy of the tool to be released.

In embodiments, the portion 26/126 may comprise an energetic reactive composite material that possesses sufficient structural integrity in a first condition to act as described above and then upon a triggering event, such as the application of an electric charge thereto, will lose that structural integrity. The loss of structural integrity may range between 1) being simply not strong enough to hold portions of the device 10 together to 2) completely disappearing.

Figure 7:
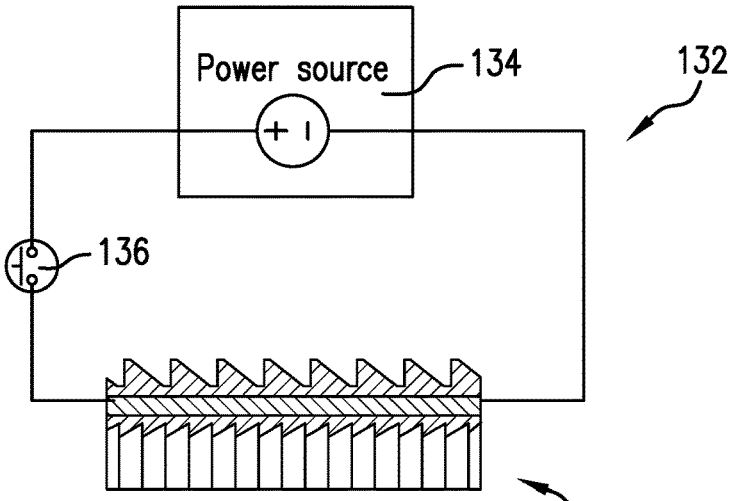
FIG. 7 is a schematic view of an energetic reactive composite triggering circuit.

Referring to FIG. 7, a schematic view of a triggering circuit 132 is illustrated. One iteration of an energetic reactive composite material triggering circuit includes a voltage source 134 electrically connected to the portion 26/126 and a switch 136 interposed between the source 134 and the portion 26/126. The switch may be configured to respond to pressure, electrical signal, magnetic signal, vibration, temperature, time, etc. When the switch closes, the portion 26/126 will degrade as discussed above. The signal may be implemented from surface or from a downhole location as desired for the particular application.

In an embodiment, the energetic reactive composite material includes an energetic material disposed in a matrix. The energetic material may be in the form of continuous fibers, wires, foils, particles, pellets, short fibers, or a combination comprising at least one of the foregoing. Once a reaction of the energetic material is initiated at one or more starting locations or points, the reaction can self-propagate through the energetic material. The matrix material, in an embodiment, comprises a polymer, a metal, a composite, or a combination comprising at least one of the foregoing, which provides the general material properties such as strength, ductility, hardness, density for tool functions. As used herein, a metal includes metal alloys. The matrix material can be corrodible or non-corrodible in a downhole fluid. The downhole fluid comprises water, brine, acid, or a combination comprising at least one of the foregoing. In an embodiment, the downhole fluid includes potassium chloride (KCl), hydrochloric acid (HCl), calcium chloride ($CaCl_2$), calcium bromide ($CaBr_2$) or zinc bromide ($ZnBr_2$), or a combination comprising at least one of the foregoing.

In an embodiment, the matrix material comprises Zn, Mg, Al, Mn, an alloy thereof, or a combination comprising at least one of the foregoing. The matrix material can further comprise Ni, W, Mo, Cu, Fe, Cr, Co, an alloy thereof, or a combination comprising at least one of the foregoing.

Magnesium alloy is specifically mentioned. Magnesium alloys suitable for use include alloys of magnesium with aluminum (Al), cadmium (Cd), calcium (Ca), cobalt (Co), copper (Cu), iron (Fe), manganese (Mn), nickel (Ni), silicon (Si), silver (Ag), strontium (Sr), thorium (Th), tungsten (W), zinc (Zn), zirconium (Zr), or a combination comprising at least one of these elements. Particularly useful alloys include magnesium alloy particles including those prepared from magnesium alloyed with Ni, W, Co, Cu, Fe, or other metals. Alloying or trace elements can be included in varying amounts to adjust the corrosion rate of the magnesium. For example, four of these elements (cadmium, calcium, silver, and zinc) have to mild-to-moderate accelerating effects on corrosion rates, whereas four others (copper, cobalt, iron, and nickel) have a still greater effect on corrosion. Exemplary commercial magnesium alloys which include different combinations of the above alloying elements to achieve different degrees of corrosion resistance include but are not limited to, for example, those alloyed with aluminum, strontium, and manganese such as AJ62, AJ50x, AJ51x, and AJ52x alloys, and those alloyed with aluminum, zinc, and manganese such as AZ91A-E alloys.

It will be understood that corrodible matrix materials will have any corrosion rate necessary to achieve the desired performance of the disintegrable article once the article completes its function. In a specific embodiment, the corrodible matrix material has a corrosion rate of about 0.1 to about 450 $mg/cm^2$/hour, specifically about 1 to about 450 $mg/cm^2$/hour determined in aqueous 3 wt. % KCl solution at 200° F. (93° C.).

In an embodiment, the matrix formed from the matrix material has a substantially-continuous, cellular nanomatrix comprising a nanomatrix material; a plurality of dispersed particles comprising a particle core material that comprises Mg, Al, Zn or Mn, or a combination thereof, dispersed in the cellular nanomatrix; and a solid-state bond layer extending throughout the cellular nanomatrix between the dispersed particles, the powder metal compact comprising deformed powder particles formed by compacting powder particles comprising a particle core and at least one coating layer, the coating layers joined by solid-state bonding to form the substantially-continuous, cellular nanomatrix and leave the particle cores as the dispersed particles. The dispersed particles have an average particle size of about 5 μm to about 300 μm. The nanomatrix material comprises Al, Zn, Mn, Mg, Mo, W, Cu, Fe, Si, Ca, Co, Ta, Re or Ni, or an oxide, carbide or nitride thereof, or a combination of any of the aforementioned materials, and wherein the nanomatrix material has a chemical composition and the particle core material has a chemical composition that is different than the chemical composition of the nanomatrix material.

The matrix can be formed from coated particles such as powders of Zn, Mg, Al, Mn, an alloy thereof, or a combination comprising at least one of the foregoing. The powder generally has a particle size of from about 50 to about 150 micrometers, and more specifically about 5 to about 300 micrometers, or about 60 to about 140 micrometers. The powder can be coated using a method such as chemical vapor deposition, anodization or the like, or admixed by physical method such cryo-milling, ball milling, or the like, with a metal or metal oxide such as Al, Ni, W, Co, Cu, Fe, oxides of one of these metals, or the like. The coating layer can have a thickness of about 25 nm to about 2,500 nm. Al/Ni and Al/W are specific examples for the coating layers. More than one coating layer may be present. Additional coating layers can include Al, Zn, Mg, Mo, W. Cu, Fe, Si, Ca, Co, Ta, Re, or No. Such coated magnesium powders are referred to herein as controlled electrolytic materials (CEM). The CEM materials are then molded or compressed forming the matrix by, for example, cold compression using an isostatic press at about 40 to about 80 ksi (about 275 to about 550 MPa), followed by forging or sintering and machining, to provide a desired shape and dimensions of the disintegrable article. The CEM materials including the composites formed therefrom have been described in U.S. Pat. Nos. 8,528,633 and 9,101,978.

The matrix material can be degradable polymers and their composites including poly(lactic acid) (PLA), poly(glycolic acid) (PGA), polycaprolactone (PCL), polylactide-co-glycolide, polyurethane such as polyurethane having ester or ether linkages, polyvinyl acetate, polyesters, and the like.

Optionally, the matrix material further comprises additives such as carbides, nitrides, oxides, precipitates, dispersoids, glasses, carbons, or the like in order to control the mechanical strength and density of the disintegrable article.

The energetic material comprises a thermite, a reactive multi-layer foil, an energetic polymer, or a combination comprising at least one of the foregoing. Use of energetic materials disclosed herein is advantageous as these energetic materials are stable at wellbore temperatures but produce an extremely intense exothermic reaction following activation, which facilitate the rapid disintegration of the disintegrable articles.

Thermite compositions include, for example, a metal powder (a reducing agent) and a metal oxide (an oxidizing agent) that produces an exothermic oxidation-reduction reaction known as a thermite reaction. Choices for a reducing agent include aluminum, magnesium, calcium, titanium, zinc, silicon, boron, and combinations including at least one of the foregoing, for example, while choices for an oxidizing agent include boron oxide, silicon oxide, chromium oxide, manganese oxide, iron oxide, copper oxide, lead oxide, and combinations including at least one of the foregoing, for example.

As used herein, energetic polymers are materials possessing reactive groups that are capable of absorbing and dissipating energy. During the activation of energetic polymers, energy absorbed by the energetic polymers cause the reactive groups on the energetic polymers, such as azido and nitro groups, to decompose releasing gas along with the dissipation of absorbed energy and/or the energy generated by the decomposition of the active groups. The heat and gas released promotes the disintegration of the disintegrable articles.

Energetic polymers include polymers with azide, nitro, nitrate, nitroso, nitramine, oxetane, triazole, and tetrazole containing groups. Polymers or co-polymers containing other energetic nitrogen containing groups can also be used. Optionally, the energetic polymers further include fluoro groups such as fluoroalkyl groups.

Exemplary energetic polymers include nitrocellulose, azidocellulose, polysulfide, polyurethane, a fluoropolymer combined with nano particles of combusting metal fuels, polybutadiene; polyglycidyl nitrate such as polyGLYN, butanetriol trinitrate, glycidyl azide polymer (GAP), for example, linear or branched GAP, GAP diol, or GAP triol, poly[3-nitratomethyl-3-methyl oxetane](polyNIMMO), poly(3,3-bis-(azidomethyl)oxetane (polyBAMO) and poly (3-azidomethyl-3-methyl oxetane) (polyAMMO), polyvinylnitrate, polynitrophenylene, nitramine polyethers, or a combination comprising at least one of the foregoing.

The reactive multi-layer foil comprises aluminum layers and nickel layers or the reactive multi-layer foil comprises titanium layers and boron carbide layers. In specific embodiments, the reactive multi-layer foil includes alternating aluminum and nickel layers.

Further information regarding the energetic reactive composite material see US Publication numbers 2018/0171757, 2018/0171757, 2018/0171737, and 2018/0171738, each of which is incorporated herein by reference in its entirety.

It is also noted that the portion 26/126 may be exposed at a periphery of the device 10 or may be enclosed within the device 10 so that the degradable material is not exposed to wellbore fluids. This can be especially helpful if in addition to the energetic reactive composite material, other degradable material that is responsive to downhole fluids is also used. For example, any portion of device 10 may also comprise a fluid degradable material that is separated from fluids until the energetic reactive composite material is triggered. In other embodiments, up to the entire device 10 may comprise energetic reactive composite material.

Figure 8:
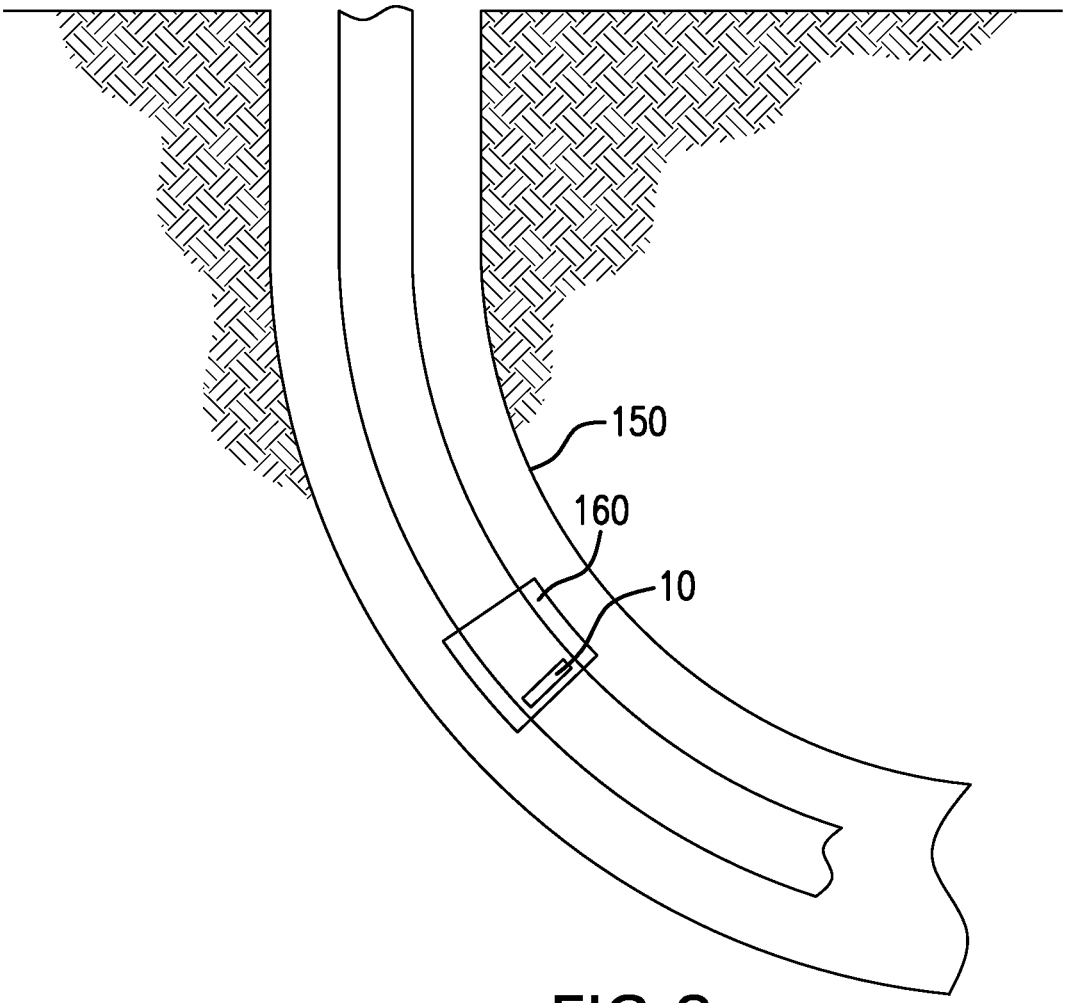
FIG. 8 is a schematic representation of a resource recovery system including the device as disclosed herein.

Referring to FIG. 8, a resource recovery system includes a borehole 150, and a tool 160 including the device 10 as described herein disposed in the borehole 150.

Set forth below are some embodiments of the foregoing disclosure:

Embodiment 1

A one-way energy retaining device including a body, at least a portion of which comprises a degradable material; a protrusion extending radially from the body that allows movement of the device along a separate structure in a first direction and prevents movement along the separate structure in the opposite direction.

Embodiment 2

The device as in any prior embodiment, wherein the at least a portion of the body is a portion that when degraded leaves the body in two separate pieces.

Embodiment 3

The device as in any prior embodiment, wherein the two separate pieces are annular pieces.

Embodiment 4

The device as in any prior embodiment, wherein the body is annular in shape.

Embodiment 5

The device as in any prior embodiment, wherein the at least a portion is an annular portion.

Embodiment 6

The device as in any prior embodiment, wherein the protrusion is a plurality of protrusions distributed about the body.

Embodiment 7

The device as in any prior embodiment, wherein protrusion is on an outside diameter surface of the body.

Embodiment 8

The device as in any prior embodiment, wherein the protrusion is on an inside diameter surface of the body.

Embodiment 9

The device as in any prior embodiment, wherein the plurality of protrusions are on both an inside diameter surface of the body and an outside surface of the body.

Embodiment 10

The device as in any prior embodiment, wherein the protrusion is a tooth.

Embodiment 11

The device as in any prior embodiment, wherein the degradable material is a energetic reactive composite material.

Embodiment 12

The device as in any prior embodiment, wherein the portion is the entire body.

Embodiment 13

The device as in any prior embodiment, wherein the device is a body lock ring.

Embodiment 14

A resource recovery system including a borehole; and a tool disposed in the borehole, the tool including a device as in any prior embodiment.

Embodiment 15

A method of storing energy and releasing stored energy in a borehole tool including urging a device as in any prior embodiment in a first direction relative to the tool in a borehole; storing in the tool, the energy that was employed during the urging; signaling the at least a portion of the body to degrade.

Embodiment 16

The method as in any prior embodiment, further including releasing the stored energy.

Embodiment 17

The method as in any prior embodiment, wherein the releasing is by separating the body into two annular portions thereby removing the ability of the body to store energy.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A one-way energy retaining device comprising:

a body, at least a portion of which comprises a degradable material that when degraded leaves the body in two separate annular pieces wherein one of the two separate annular pieces is radically inwardly disposed of the other of the two separate annular pieces;

a protrusion extending radially from the body that allows movement of the device along a separate structure in a first direction and prevents movement along the separate structure in the opposite direction.

2. The device as claimed in claim 1 wherein the body is annular in shape.

3. The device as claimed in claim 1 wherein the at least a portion is an annular portion.

4. The device as claimed in claim 1 wherein the protrusion is a plurality of protrusions distributed about the body.

5. The device as claimed in claim 1 wherein protrusion is on an outside diameter surface of the body.

6. The device as claimed in claim 1 wherein the protrusion is on an inside diameter surface of the body.

7. The device as claimed in claim 4 wherein the plurality of protrusions are on both an inside diameter surface of the body and an outside surface of the body.

8. The device as claimed in claim 1 wherein the protrusion is a tooth.

9. The device as claimed in claim 1 wherein the degradable material is an energetic reactive composite material.

10. The device as claimed in claim 1 wherein the portion is the entire body.

11. The device as claimed in claim 1 wherein the device is a body lock ring.

12. A resource recovery system comprising:

a borehole; and a tool disposed in the borehole, the tool including a device as claimed in claim 1.

13. A method of storing energy and releasing stored energy in a borehole tool comprising:

urging a device as claimed in claim 1 in a first direction relative to the tool in a borehole;

storing in the tool, the energy that was employed during the urging;

signaling the at least a portion of the body to degrade.

14. The method as claimed in claim 13 further including releasing the stored energy.

15. The method as claimed in claim 14 wherein the releasing is by separating the body into two annular portions thereby removing the ability of the body to store energy.

* * * * *